US005953811A

United States Patent [19]

Mazzochette

[11] Patent Number: 5,953,811

[45] Date of Patent: Sep. 21, 1999

[54] TRIMMING TEMPERATURE VARIABLE RESISTOR

[75] Inventor: Joseph B. Mazzochette, Cherry Hill, N.J.

[73] Assignee: EMC Technology LLC, Cherry Hill, N.J.

[21] Appl. No.: 09/008,784

[22] Filed: Jan. 20, 1998

[51] Int. Cl.[6] ..... H01C 7/00; H01C 17/28

[52] U.S. Cl. ..... 29/612; 29/621; 29/874; 29/593

[58] Field of Search ..... 29/612, 610.1, 29/621, 593, 874; 338/22 R, 7, 8, 9, 195

[56] References Cited

U.S. PATENT DOCUMENTS

| | | | |
|---|---|---|---|
| 3,738,919 | 6/1973 | Chilton et al. . | |
| 3,745,506 | 7/1973 | Bethe | 338/22 R |
| 4,041,440 | 8/1977 | Davis et al. | 338/195 |
| 4,200,970 | 5/1980 | Schonberger | 29/593 |
| 4,454,495 | 6/1984 | Werner et al. | 338/9 |
| 4,907,341 | 3/1990 | Chapel, Jr. et al. | 29/612 |
| 5,798,685 | 8/1998 | Katsuki et al. | 338/22 R |

FOREIGN PATENT DOCUMENTS

| | | | |
|---|---|---|---|
| 3-173101 | 7/1991 | Japan | 338/7 |

*Primary Examiner*—P. W. Echols
*Attorney, Agent, or Firm*—Donald S. Cohen

[57] ABSTRACT

The temperature coefficient of resistance (TCR) of a resistor having a layer of a resistance material on a surface of a substrate and a termination layer of a conductive material at opposite ends of the resistance layer is adjusted by changing the area of at least one of the termination layers. The area of the termination layer is changed by removing a portion of the termination layer. The portion of the termination layer can be removed by making a cut through the termination layer which extends along a line across at least a portion of the termination layer. This method can be used to form matched pairs of resistors by first adjusting the resistance value of at least one of a pair of the resistors at room temperature to provide the resistors with substantially the same resistance values. The TCR of one of the resistors is then adjusted by removing a portion of one of the terminations of the resistor until both resistors have substantially the same TCR.

5 Claims, 1 Drawing Sheet

TRIMMING TEMPERATURE VARIABLE RESISTOR

FIELD OF THE INVENTION

The present invention relates to a method of trimming a temperature variable resistor, such as a thermistor, and, more particularly, to a method of adjusting the temperature coefficient of resistance (TCR) of such a resistor.

BACKGROUND OF THE INVENTION

It is often desirable to adjust the resistance value of a resistor to bring the resistance of the resistor to a desired value. For a film type resistor, i.e., a resistor having a film of a resistance material on the surface of a substrate and spaced terminations of a conductive material at the ends of the resistance film, this adjustment is generally achieved by changing the dimensions, i.e, the width and/or length, of the path of the resistance film between the terminations. This technique is referred to as "trimming" the resistance value of the resistor. One method of trimming the resistor is to cut a groove through the resistance film so as to change the width of the resistance. If the resistance film is on a cylindrical substrate, the groove can extend in a spiral path around the substrate. If the resistance film is on a flat surface of a substrate, the groove can extend from one edge of the resistance film or spaced grooves can be provided extending from opposite sides of the resistance path. This technique is shown in the U.S. Pat. No. 4,041,440, of James L. Davis et al, issued Aug. 9, 1977 and entitled "Method of Adjusting Resistance of a Thick-Film Thermistor".

A resistor whose resistance varies with changes in temperature, such as a thermistor, not only can require an adjustment of the resistance value of the resistor, but also an adjustment (trimming) of the temperature coefficient of resistance (TCR) of the resistor. Trimming the resistance value of the resistor by changing the length of the path of the resistor does not trim the TCR of the resistor. One method of adjusting the TCR of a temperature variable resistor is to change the composition of the thermistor material prior to making the thermistor. However, this will not compensate for variations in the geometry of the device after it is made. Therefore, it would be desirable to have a simple technique for trimming the TCR of a temperature variable resistor after the resistor is made.

SUMMARY OF THE INVENTION

A method of adjusting the temperature coefficient of resistance (TCR) of a temperature variable resistor which has a layer of a resistance material on a surface of a substrate and a termination layer of a conductive material on the substrate surface and contacting the resistance layer. The method includes removing a portion of the termination layer, determining the TCR of the resistance, and discontinuing any further removal of the termination layer when a desired TCR is reached.

DETAILED DESCRIPTION

Figure 1:
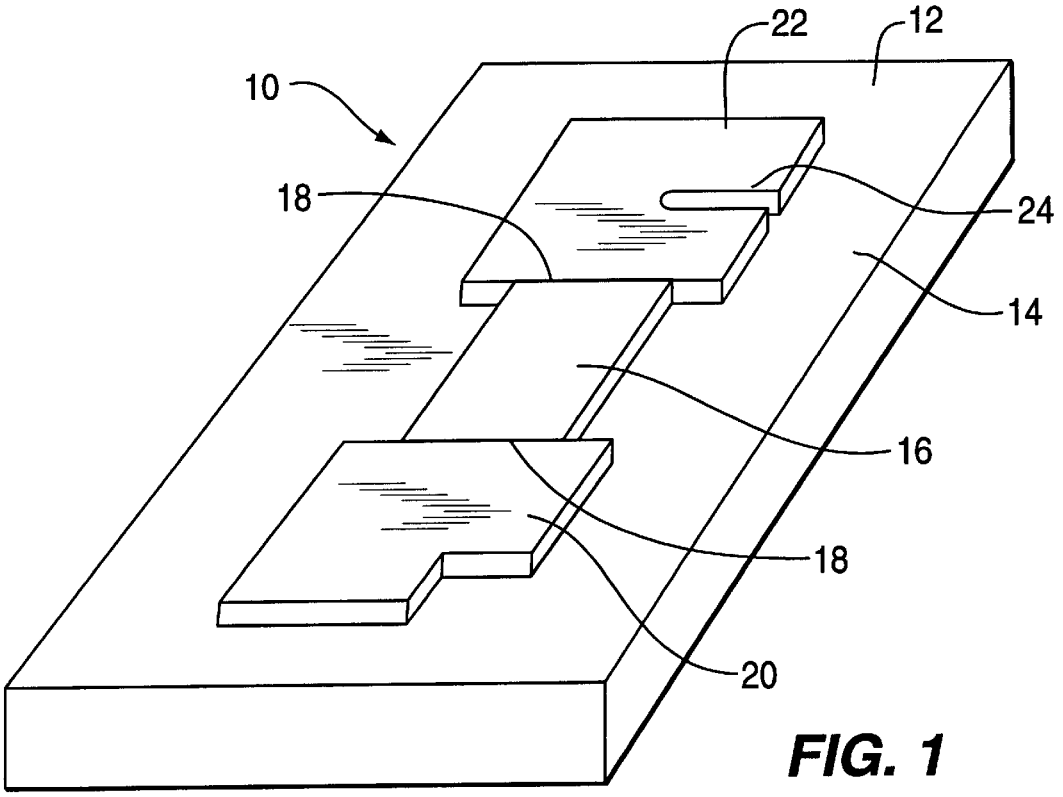
FIG. 1 is a perspective view of a film type temperature variable resistor showing the method of the present invention for adjusting the TCR of the resistor.

Referring initially to FIG. 1, a film type temperature variable resistor, such as a thermistor, is generally designated as 10. Thermistor 10 comprises a substrate 12 of an insulating material, such as a plastic or ceramic, having a good thermal conductivity. The substrate 12 has a flat surface 14. On the substrate surface 14 is a layer 16 of a thermistor material, i.e, a, resistance material having a temperature variable resistance. The resistance layer 16 is in the form of a strip having ends 18. On the substrate surface 14 at each of the ends 18 of the resistance layer 16 is a termination layer 20 and 22 respectively of a conductive material, such as a metal,. Each of the termination layers 20 and 22 contacts a separate end 18 of the resistance layer 16

The temperature coefficient of resistance (TCR) of a resistor or thermistor is a measure of the change in the value of the thermistor relative to the temperature of the thermistor material. TCR is normally expressed in parts per million per °C. relative to a reference temperature and value (usually the value at 25° C.). The thermistor material temperature can change for two reasons. First, the temperature of the thermistor material of a device, $T_m$, will change with ambient temperature by the following relation:

$$T_m=T_i+(T_a-Ti)e^{(kt)} \tag{1}$$

where $T_i$=initial material temperature $T_a$=ambient temperature

K=the thermal resistance of the device assembly t=time

The second reason for change in the thermistor temperature is due to power dissipation. As current is applied to the thermistor, the electrical energy is converted to heat. The amount of power, $P_t$, that the thermistor must dissipate is given by:

$$P_t=I_t^2R_t \tag{2}$$

where $I_t$=the current in the thermistor $R_t$=the resistance of the thermistor $$R_t=R_{25}+R_{25}(25-T_m)TCR \tag{2a}$$

where $R_{25}$=the resistance of the thermistor at $^{25oC}$

TCR=the TCR of the thermistor

The temperature of the thermistor material, $T_m$, is a function of the power dissipated and the thermal resistance of the heat sink. Heat sinking is done by three methods, conduction, convection and radiation. Since the thermistor is constructed on a substrate of a heat conductive material, the primary sinking is by conduction and the other two methods can be ignored. The following equation gives $T_m$, for the thermistor shown in FIG. 1:

$$T_m=T_a+P_t\Theta \tag{3}$$

where $$\theta = \text{the heat sink thermal resistance}$$

$$= d/(4.186kA)\,°\text{C./Watt}$$

d=the substrate thickness

A=the area of the thermistor k=the thermal conductivity of the material of the substrate Equation 3 shows that $T_m$ will decrease as the area of the thermistor is increased. If $T_m$ decreases, $R_t$ will vary according to 2a. The area of the thermistor is that part of the thermistor that makes contact with the substrate. The area is effectively increased by the area of the terminations 20 shown in FIG. 1. The terminations act like heat spreaders carrying heat from the thermistor through either end and conducting the heat into the heat sink (the substrate) along the contact surface between the termination and the substrate. If the area of the terminations is reduced, then $T_m$ will increase and $R_t$ will change. The result is that the $R_t$ due to self heating from power dissipation can be affected by the area of the metal thermistor terminals. Again from equation 2a, changing the area of the terminals has the same effect on $R_t$ as does changing the TCR in the case of self heating.

Thus, the TCR of the thermistor 10, which is a function of self heating, can be changed, by changing the area of the terminations 20 and 22. For a film type thermistor 10, the TCR of the thermistor can be changed after the thermistor is formed, by removing some of the material of one or both of the terminations 20 and 22. One technique for removing some of the material of a termination can be to scrape away a portion of the termination, such as the termination 20 shown in FIG. 1. Another technique for removing some of the material of a termination is to cut lines 24 through a termination 22 which line 24 extend across a portion of the termination 22.

Figure 2:
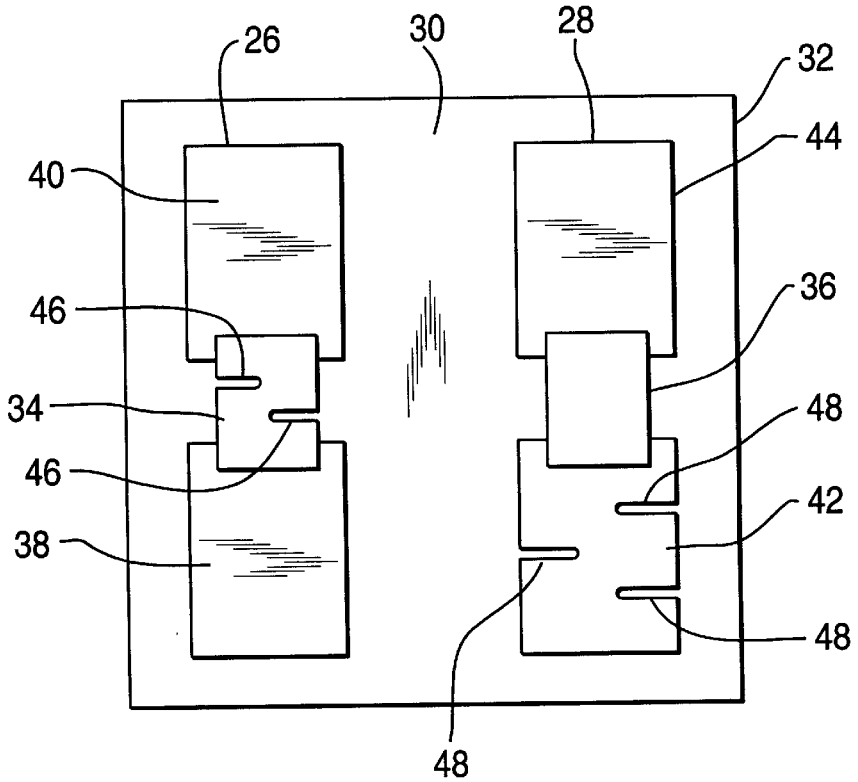
FIG. 2 is a top view showing the method of the present invention for adjusting two temperature variable resistors to the same resistance value and TCR.

Referring now to FIG. 2, there is illustrated using the method of the present invention to adjust the resistance value and the TCR of two thermistors 26 and 28 to form a pair of matched thermistors. The thermistors 26 and 28 are formed on the surface 30 of a substrate 32 of an insulating material, such as a plastic or ceramic, having a good thermal conductivity. Although the thermistors 28 and 30 are shown as being formed on a common substrate, they can be formed on separate substrate. The thermistors 26 and 28 comprise a layer 34 and 36 respectively of a resistance material having a desired TCR on the substrate surface 30. The resistance layers 34 and 36 are each in the form of a strip. Termination layers of a conductive material, such as a metal, are on the substrate surface 30. Termination layers 38 and 40 are at and contact opposite ends of the resistance strip 34, and termination layers 42 and 44 are at and contact opposite ends of the resistance strip 36.

It is often desirable to have matched thermistors. Matched thermistors are often used to measure ambient temperature, power dissipation, voltage levels, etc. Thermistor matching from device-to-device and lot-to-lot reduces the need for calibration and matched devices can be used as compensation for variations in ambient temperature. One thermistor can be used to monitor current, voltage or power while another matched thermistor can monitor and null the effects of ambient temperature changes.

To form matched thermistors using the method of the present invention, the first step is to adjust the resistance value of the resistance strips 34 and 36 at room temperature to bring them to the same resistance value. This can be achieved by trimming one or both resistance strips 34 and 36. After measuring the resistance values of the resistance strips 34 and 36 at room temperature, the resistance strip having the lower value can be trimmed up to the resistance value having the higher value by increasing the length of the path of the resistance strip. As shown, the resistance strip 34 is trimmed by providing cuts 46 through the layer forming the resistance strip 34 which extend across the resistance strip 34. If desired, both resistance strips 34 and 36 can be trimmed to bring them both to a common resistance value which is higher than either of the resistance strips.

After the thermistors 26 and 28 are trimmed to have the same resistance value at room temperature, a constant current source is applied to each thermistor 26 and 28. The voltage drop across each thermistor is then measured while identical currents heat the thermistors. If the thermistors' thermal resistance are the same then the voltages will be identical. If, however, one voltage differs from the other, they can be equalized by removing material from one of the terminations of the higher voltage device in the case of a thermistor having a negative temperature coefficient (NTC), or from the lower voltage device in the case of a thermistor having a positive temperature coefficient (PTC). This can be achieved by cutting lines across a portion of the appropriate termination, such as cutting lines 48 across the termination 42 of the thermistor 28, as shown in FIG. 2. The removal of terminal material reduces the heatsinking of the thermistor by the terminal and consequently, the resistance of the thermistor due to self heating will change. Thus, the two thermistors 26 and 28 now have both the same resistance values at room temperature as well as the same TCR.

Thus, there is provided by the present invention a method of trimming the TCR of a temperature variable film type resistor after the resistor is formed. The TCR is easily adjusted by changing the area of one or more of the conductive terminations of the thermistor. The method of the present invention can also be used to form matched thermistors which have both the same resistance value at room temperature as well as the same TCR.

What is claimed is:

1. A method of adjusting the temperature coefficient of resistance (TCR) of a temperature variable resistor which is a layer of a resistance material on the surface of a substrate and a termination layer of a conductive material on the substrate and contacting the resistance layer, the method comprising the steps of:

removing a portion of the termination layer;

determining the TCR of the resistor; and discontinuing any further removal of the termination layer when a desired TCR is reached.

2. The method of claim 1 wherein the resistance layer has a pair of spaced ends, a separate termination layer is on the surface of the substrate at each end of the resistance layer, and a portion of at least one of the termination layers is removed.

3. The method of claim 2 wherein the portion of the termination layer is removed by making a cut through the termination layer which cut extends in a line along a portion of the termination layer.

4. The method of claim 3 in which prior to removing a portion of the termination layer to adjust the TCR of the resistor, the resistance of the resistance layer is adjusted by changing the dimensions of the path of the resistance layer between the termination layers.

5. The method of claim 4 in which the dimensions of the path of the resistance layer is increased by forming a cut through the resistance layer along a line extending along at least a portion of the resistance layer.

* * * * *